US005526997A

United States Patent [19]

Karczmer

[11] Patent Number: 5,526,997

[45] Date of Patent: Jun. 18, 1996

[54] REELING DEVICE

[75] Inventor: Claude M. Karczmer, New York, N.Y.

[73] Assignee: Xedit Corporation, Queens Village, N.Y.

[21] Appl. No.: 266,590

[22] Filed: Jun. 28, 1994

[51] Int. Cl.[6] ..... B65H 75/38

[52] U.S. Cl. ..... 242/388.5; 191/12.2 R

[58] Field of Search ..... 242/388, 388.1, 242/388.5, 378, 378.4; 191/12.2 R, 12.4

[56] References Cited

U.S. PATENT DOCUMENTS

| | | | |
|---|---|---|---|
| 1,322,407 | 11/1919 | Chegwidden et al. . | |
| 1,946,778 | 2/1934 | Cline . | |
| 1,958,626 | 5/1934 | Krantz . | |
| 2,194,933 | 3/1940 | Fullerton . | |
| 2,438,515 | 3/1948 | Mohler . | |
| 3,061,234 | 10/1962 | Morey | 191/12.2 R |
| 3,545,693 | 12/1970 | Gurner et al. | 242/388.5 |
| 3,657,491 | 4/1972 | Ryder et al. | 242/378 |
| 3,782,654 | 1/1975 | Kasa . | |
| 3,809,331 | 5/1974 | Gaul . | |
| 3,858,011 | 12/1974 | Salvin et al. | 242/378.4 |
| 4,040,043 | 8/1977 | Stanford . | |
| 4,261,525 | 4/1981 | Wagner . | |
| 4,436,190 | 3/1984 | Wentzell . | |
| 4,757,955 | 7/1988 | Simmons | 242/378 |
| 4,989,805 | 2/1991 | Burke . | |
| 5,094,396 | 3/1992 | Burke . | |
| 5,332,171 | 7/1994 | Steff | 242/378 |

*Primary Examiner*—John P. Darling
*Attorney, Agent, or Firm*—Bacon & Thomas

[57] ABSTRACT

A reeling device includes a housing having multiple chambers within which are respectively mounted, for rotation in unison, main and secondary reels. Preferably the main and secondary reels include a common hub member that is formed with a hole extending therethrough from the main reel to the secondary reel. A single length of cable is wound upon the two reels with a first end portion of the cable being coiled upon the main reel, an intermediate portion thereof extending through the hole formed in the common hub member and a second end portion of the cable being coiled about the secondary reel. The second end portion of the cable is substantially shorter than the first end portion and includes an end that is fixed to the housing. With this arrangement, as the first portion of the cable is fully unwound from the main reel, the second portion of the cable is simultaneously unwound from and then rewound onto the secondary reel such that a compact reeling device is provided without the use of slip rings and with a minimal amount of cable being required. The reeling device further includes a drive system for controlling the rate of deployment and automatic retraction of the cable.

17 Claims, 3 Drawing Sheets

93
16
94
103
105
10
5
91
2
-8-
16
27
14
60
74
75
63

94
93
103
105
8
16
112
109
108
74
97
14
10
27

94
98
109
116
51
108
53
49
74
75
16
63
36
8
-18-
37
88
-27-
20
128
125
14
30
23
41
50
39
46
43
10
60

FIG. 4
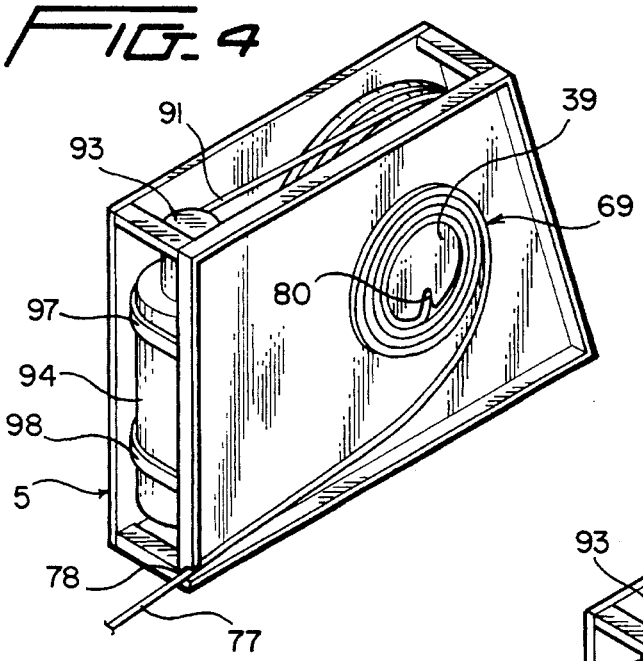
FIG. 5
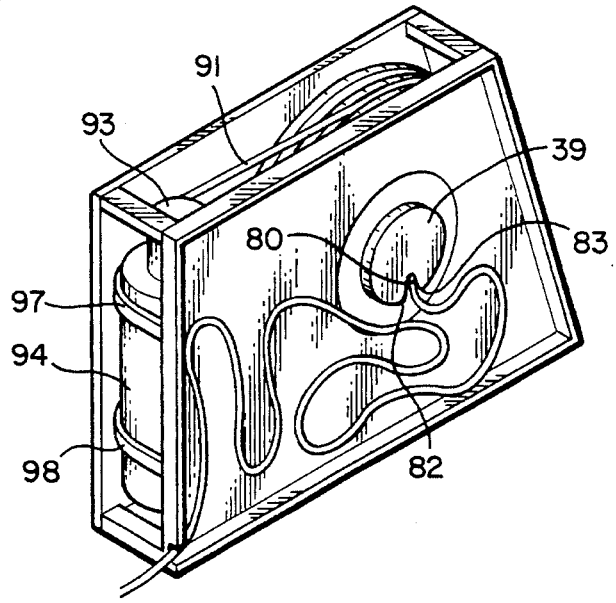
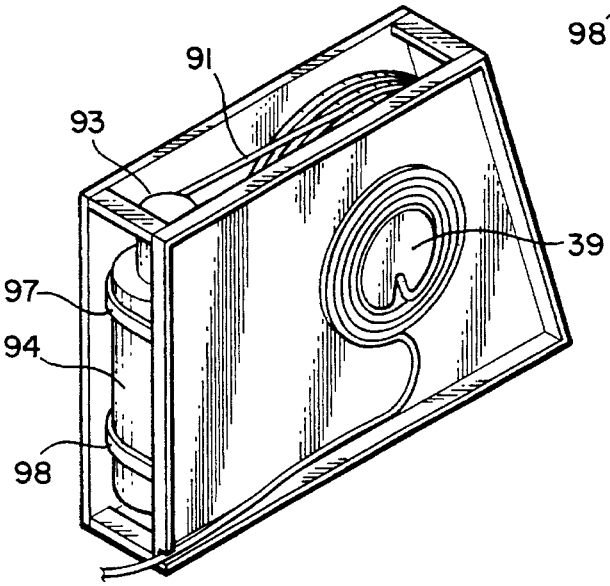
FIG. 6
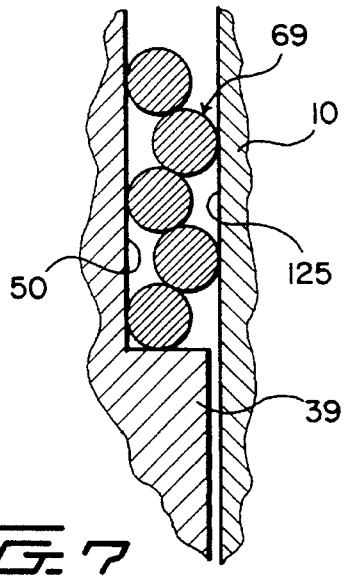
FIG. 7

REELING DEVICE

BACKGROUND OF THE INVENTION

1. Field of the Invention

The present invention pertains to the art of reeling devices and, more particularly, to a compact reeling device for the controlled coiling and uncoiling of a cable from within a housing wherein one end of the cable is fixed to the housing and the other end can be pulled to deploy a desired length of cable.

2. Discussion of the Prior Art

It is widely known in the art to wind and unwind cables from a reeling device. Most often, such a reeling device includes a hub having one end of the cable located at the center of the hub and the remainder of the cable being wound in successive radial layers. In such a reeling device, if one end portion of the cable is fixed relative to the remainder of the cable in order to provide a stationary electrical connection location, some provision must be made to prevent the stationary portion of the cable from twisting, kinking and ultimately failing as the reel is rotated during winding and unwinding of the cable.

In many known reeling devices, such as those commonly used for droplights and vacuum cleaners, slip rings are employed to provide an electrical connection between the stationary and rotatable portions of the cable. Such slip rings can be the source of undesirable electrical noise and intermittent electrical contact. These problems become increasing important when such a reeling device is used in connection with an audio cable. For example, if slip rings are utilized in a microphone cable reeling device wherein a DC power source is superimposed onto an audio signal line of the cable, the slip rings would have to handle both the audio and DC components. This arrangement would generate an undesirable amount of audible brush noise.

In order to overcome the drawbacks associated with using slip rings on reeling devices in certain environments, it has heretobefore been proposed to wind a cable upon both main and auxiliary hubs such that a transitional cable portion would be present between the main cable portion and the fixed cable end. This transitional cable portion would wind and unwind in unison with the main cable portion. Initial designs of this type required the length of the transitional cable portion to be equal to that of the main cable portion. Obviously, such an arrangement disadvantageously results in increased size and cost of the reeling device without the length of the transitional cable portion adding to the effective deployment length of the cable. This problem has been somewhat addressed in the prior art by reducing the hub diameter of the auxiliary reel relative to the main reel. Unfortunately, even varying the diameters of the hubs in this fashion does not significantly reduce the overall bulk of such known reeling devices and certainly does not provide for an extremely compact reeling device.

In reeling devices, it is often desirable to provide a certain degree of tension on the cable while being deployed, while also providing some type of arrangement for maintaining the cable in a desired position once deployed. In the prior art reeling devices, it is common to utilize a mechanical spring which coils as the cable is deployed so as to maintain tension on the cable, as well as a pawl-type locking arrangement for maintaining the cable in a desired deployed position. Such spring/pawl-type reeling devices have various undesirable characteristics. For example, relatively minor tugs on the cable often result in unwanted, sudden and uncontrolled retraction of the cable. Also, locking of the cable is generally limited to particular locations governed by the positioning of the pawl. If too much retraction speed is developed, the pawl may even miss its engaging position and allow further unwanted retraction. Finally, unless controlled in some manner, the retraction speed can become excessive, resulting in a potentially dangerous situation due to whipping of the cable.

Therefore, there exists a need in the art for a compact reeling device which avoids the use of slip rings and which maximizes the length of deployable cable relative to the total length of cable utilized in order to provide for an extremely compact design. In addition, there exists a need for a reeling device wherein the cable can be effectively maintained in a desired location, while ensuring the safe deployment and retraction of the cable.

SUMMARY OF THE INVENTION

It is an object of the present invention to provide a reeling device including a single length of cable wound upon main and secondary reels that are rotatably mounted within a housing to which one end of the cable is fixed wherein the amount of cable provided on the secondary reel is minimized.

It is another object of the present invention to provide a compact reeling device wherein the deployment and retraction of the cable is controlled in a safe and efficient manner.

It is a further object of the present invention to provide a method of reeling and unreeling a cable upon a compact reeling device including main and secondary reels having wound thereon a single length of cable.

These and other objects of the invention are achieved by providing a compact reeling device including a housing having multiple chambers within which are respectively mounted, for rotation in unison, main and secondary reels. Preferably the main and secondary reels include a common hub member that is formed with a hole extending therethrough from the main reel to the secondary reel. A single length of cable is wound upon the two reels with a first end portion of the cable being coiled upon the main reel, an intermediate portion thereof extending through the hole formed in the common hub member and a second end portion of the cable being coiled about the secondary reel. The second end portion of the cable is substantially shorter than the first end portion and includes an end that is fixed to the housing. With this arrangement, as the first portion of the cable is fully unwound from the main reel, the second portion of the cable is simultaneously unwound from and then rewound onto the secondary reel.

The reeling device further includes a drive system for controlling the winding and unwinding of the cable upon the reels. In the preferred embodiment, the drive system includes a servomotor that is drivingly connected to the common hub member and responsive to tension placed on the cable. The drive system provides for controlled deployment of the cable by providing a resistive torque to the deployment of the cable when excessive force is applied to withdraw the cable from the housing and controlled retraction by establishing a safe re-coil rate. The drive system is also responsive to signals received from optical sensors, positioned adjacent to the main reel, for indicating fully wound and fully unwound states of the cable respectively. The sensors are fixed to the housing and function to sense the absence or presence of the cable at specified radial distances from the hub of the main reel through a transparent flange portion of the main reel.

Other objects, features and advantages of the present invention will become more readily apparent from the following detailed description of a preferred embodiment thereof when taken in conjunction with the drawings wherein like reference numerals refer to corresponding parts in the several views.

BRIEF DESCRIPTION OF THE DRAWINGS

FIG. 4 is a partial perspective view of the reeling device in a fully wound state;

FIG. 5 is a partial perspective view of the reeling device in a partially unwound state;

FIG. 6 is a partial perspective view of the reeling device in the fully unwound state;

FIG. 7 is a partial cross-sectional view of a hub portion of the reeling device with various successive radially coiled layers of cable thereon.

DETAILED DESCRIPTION OF THE PREFERRED EMBODIMENT

Figure 1:
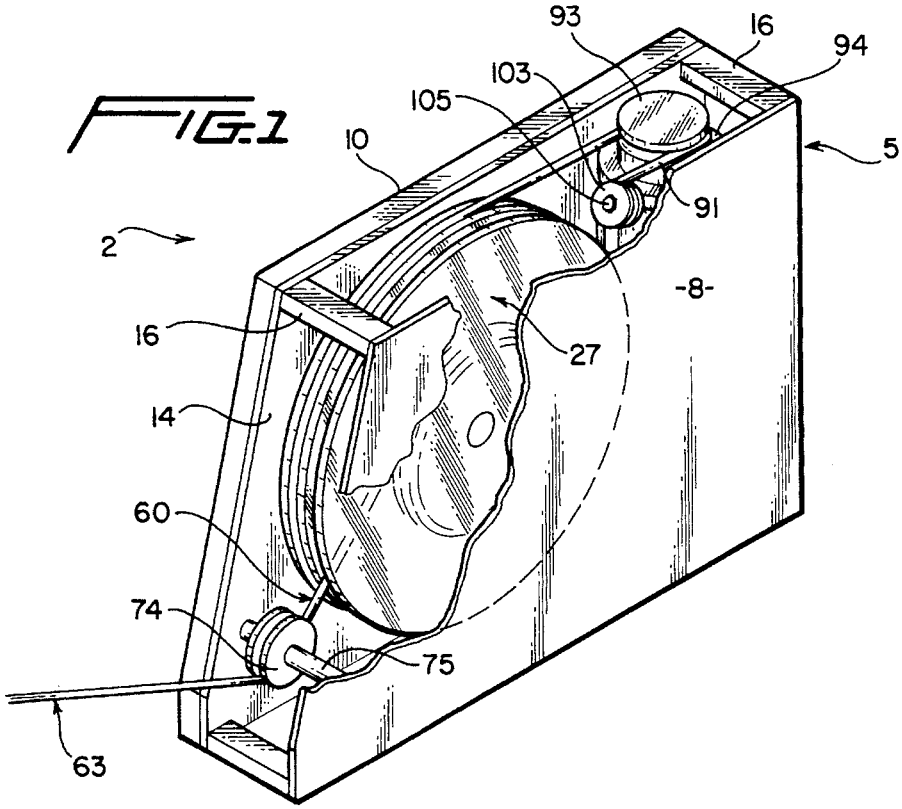
FIG. 1 is partial cut-away view of the reeling device of the present invention.
Figure 2:
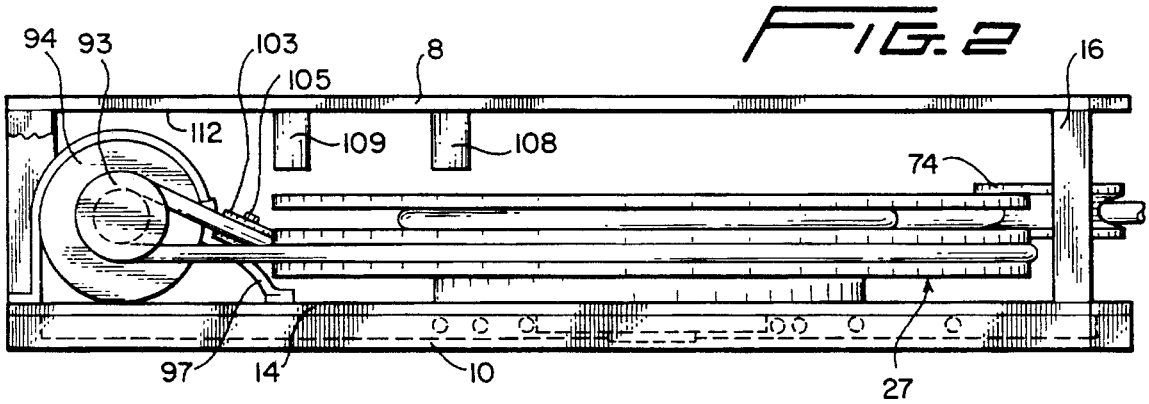
FIG. 2 is a top view of the internal structure of the reeling device of FIG. 1.
Figure 3:
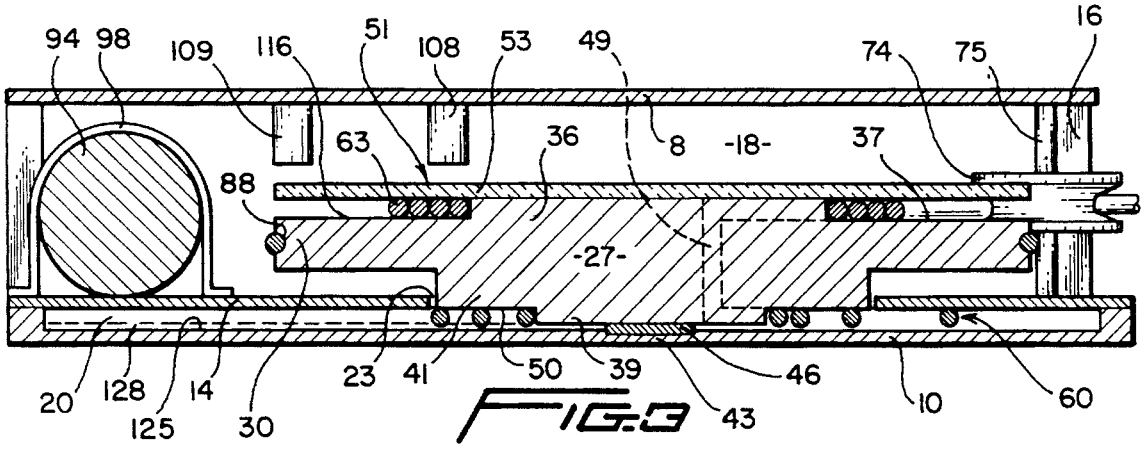
FIG. 3 is a cross-sectional view of the reeling device of FIG. 2.

With initial reference to FIGS. 1–3, the reeling device of the present invention is generally indicated at 2. Reeling device 2 includes a housing 5 consisting of a first side wall 8, an opposing side wall 10 and various peripheral side wall which are not depicted in the drawings. Housing 5 is divided by a partition member 14, attached to first side wall 8 through a plurality of circumferentially spaced cross braces 16, into first and second chambers 18 and 20. Partition member 14 includes a central aperture 23 which opens first chamber 18 into second chamber 20.

Reeling device 2 also includes a hub member 27 that is formed with a central flange 30. Hub member 27 includes a main hub portion 36 formed at a first side 37 of central flange 30 and a secondary hub portion 39 projecting from an auxiliary flange portion 41 of central flange 30. Hub member 27 is rotatably mounted within housing 5 by means of a connector portion 43 of a bearing unit (not shown) that is positioned within and defines a centrally located rotational axis for hub member 27. As shown, connector portion 43 engages side wall 10 of housing 5 in order to support hub member 27 with a friction reducing washer 46 therebetween. Hub member 27 is provided with a through hole 49 that extends between main hub portion 36 and secondary hub portion 39 and is radially spaced from the central rotational axis of hub member 27.

Although more fully discussed below, at this point, it should be noted that, as best shown in FIG. 3, when hub member 27 is mounted within housing 5, an outer surface 50 of auxiliary flange portion 41 of central flange 30 is substantially co-planar with partition member 14 and secondary hub portion 39 projects within second chamber 20 of housing 5. In addition, main hub portion 36 and central flange 30 are positioned wholly within first chamber 18.

Reeling device 2 defines a main reel generally indicated at 51. Main reel 51 is defined by main hub portion 36, central flange 30 and another flange member 53 that is secured for rotation to main hub portion 36 by any means known in the art. For the reasons which will be more fully discussed below, flange member 53 is preferably formed from a transparent material such as plexiglass. A single length cable 60 includes a first, main portion 63 that is coiled around main hub portion 36 between central flange 30 and transparent flange member 53, an intermediate section 66 (not shown) that extends within through hole 49 and a second portion 69 that is coiled about secondary hub portion 39.

As best shown in FIGS. 2 and 3, central flange 30 and transparent flange member 53 are preferably spaced a distance only slightly greater than the width of cable 60. With this arrangement, first portion 63 of cable 60 is coiled in successive radial layers. As best shown in FIGS. 1 and 2, first portion 63 extends about a guide pulley 74 and out of housing 5. Guide pulley 74 is rotatably mounted upon a shaft 75 that is fixed to both first side wall 8 and partition member 14.

Second portion 69 of cable 60 includes an end section 77 that is shown in FIGS. 4–6 to project through an aperture 78 formed in housing 5. Although not shown in the drawings, it is to be understood that end section 77 is fixed to housing 5, either at or adjacent to aperture 78, such that the length of cable 60 within second chamber 20 is finite and remains constant. The particular length of second portion 69 is chosen based on the relative diameters between main and secondary hub portions 36, 39 and the desired pay-out or deployment length of first portion 63. Therefore, a substantial length of cable 60 can extend through aperture 78 for attaching cable 60 to an electrical unit or cable 60 could terminate in an electrical connector at aperture 78.

As shown in FIGS. 4–6, secondary hub portion 39 is formed with a generally V-shaped slot 80 that leads to through hole 49. V-shaped slot 80 is provided with curved edges 82 and 83 which enables second portion 69 to be smoothly coiled about secondary hub member 39 in either direction. By this arrangement, second portion 69 of cable 60 can be considered a loop of cable that is held captive within a bin defined by second chamber 20. This bin configuration therefore provides the transition between deployable first portion 63 and a stationary output. The reeling device 2 is designed to handle this loop without jamming during operation thereof while maintaining this loop of cable isolated from forces exerted on first portion 63 as discussed more fully below.

In the preferred embodiment, central flange 30 is provided with an annular recess 88 (see FIGS. 2 and 3) that receives a drive belt 91 forming part of a drive system. Drive belt 91 is depicted as a round varathane belt although various round and/or flat belts could be utilized. Drive belt 91 further extends about an output pulley 93 of a drive motor 94. In the preferred embodiment, drive motor 94 constitutes a servomotor that can be driven in a uni-directional manner but which can be rotated in an opposite direction in an overrunning manner. Servomotor 94 receives drive power through a portable DC power source provided within housing 5 for controlling the winding and unwinding of cable 60 as discussed more fully below. Servomotor 94 is secured to housing 5 by means of two brackets 97 and 98. Drive belt 91 further extends around a transition pulley 103 (see FIGS. 1 and 2) that alters the orientation of drive belt 91. Transition pulley 103 is rotatably mounted to bracket 97 by means of a bolt 105.

Servomotor 94 is also responsive to signals from optical activation/de-activation sensors 108 and 109, preferably infrared sensors. As shown, sensors 108, 109 are secured to an inner surface 112 of first side wall 8 and sense the presence or absence of cable 60 from a predetermined portion of main hub portion 36. More specifically, sensor 108 is positioned directly adjacent the outer radial end of main hub portion 36. Sensor 108 emits a light beam that will be reflected back to sensor 108 by radial surface portion 116 of central flange 30 if cable 60 is not present. For this purpose, radial surface portion 116 preferably evinces a highly polished surface or is coated with a metallic, highly reflective coating. If sensor 108 receives a reflected signal, this indicates that first portion 63 of cable 60 is fully deployed or unwound and a signal is sent, through suitable circuitry as discussed more fully below with reference to FIG. 8, to servomotor 94 in order to prevent further unwinding. When sensor 108 indicates that first portion 63 is fully deployed, drive motor 94 is automatically operated to retract cable 60 a predetermined amount necessary to ensure that some cable remains on main reel 51 in order to permit tension commands to be sensed as further discussed below. Sensor 109 operates in a similar fashion to prevent overwinding of cable 60.

A detailed description of the manner in which reeling device 2 operates will now be provided. Initially, it should be noted that servomotors such as that incorporated in reeling device 2 are available in today's marketplace such as those sold by the Canon Corporation, as well as the generator unit which provides motion sensing to the system. In the preferred embodiment, drive motor 94 is responsive to forces exerted on first portion 63 of cable 60 by an operator of reeling device 2. If first portion 63 is withdrawn at a rate such that a permissible tension level is maintained on cable 60 and hub member 27 does not overrun which could cause undesirable slack in first portion 63 of first reel 51, servomotor 94 will remain deactivated and will be permitted to rotate in a direction opposite to its rotational drive direction. The interconnection of servomotor 94 to hub member 27 will provide a feedback tension on cable 60. However, when a predetermined threshold force on first portion 63 is exceeded as sensed by the generator unit, servomotor 94 will begin to rotate in a direction opposite to the deployment direction of cable 60 from main hub portion 36 so as to provide an increased resistance that can be felt by the user. When first portion 63 of cable 60 is deployed the desired length and held momentarily to allow the system to sense the cessation of pull, servomotor 94 is deactivated. With this arrangement, the user can stop the deployment of cable 60 at any desired position. Of course, a pulling or tension force could again be applied to first portion 63 of cable 60 to increase the deployment length thereof or, if desired, cable 60 can be retracted within housing 5 by exerting an initial pulling force on first portion 63 and then releasing cable 60 which activates servomotor to rewind cable 60 at a controlled rate. By this arrangement, reeling device 2 is insensitive to small or inadvertent pulls on cable 60, while responding reliably to intentional cable pull commands. The sensitivity of the system, as well as the cable retraction speed, can be set based on system parameters and user preferences. For example, in a preferred embodiment, the retraction speed is set to six inches of cable per second.

Figure 8:
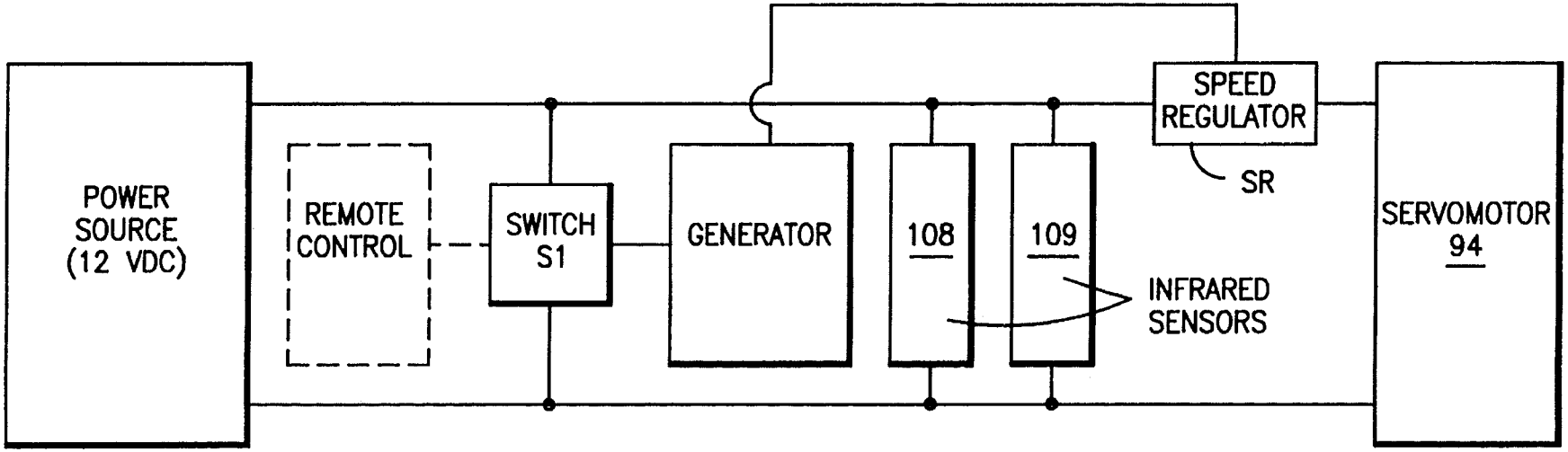
FIG. 8 is a schematic diagram of the control circuitry for the reeling device of the invention.

Since the specific construction and internal operation of servomotor 94 is not part of the present invention, it will not be further discussed in detail. However, FIG 8 schematically illustrates the circuit arrangement used to control the operation of servomotor 94. If reeling device 2 is idle, switch S1, preferably comprised of transistors, will be closed which will function to interrupt the supply of power from the power source to servomotor 94. In addition, since hub member 27 is stationary, the generator will not be rotated. When cable 60 is pulled upon to deploy first portion 63, the generator will be rotated with the rotation of hub member 27. If first portion 63 is withdrawn from housing 5 at a permissible rate, the system will remain in its present state. If first portion 63 is with greater force, the generator will produce a positive voltage signal which will cause switch S1 to open, thereby causing servomotor 94 be activated in order to provide a resistive force to the deployment of cable 60. The voltage generated will also control a speed regulator SR to reduce to power actually supplied to servomotor 94 by the power source such that servomotor 94 operates at a first, low level in order to provide the desired holdback torque that can be sensed by the user.

Infrared sensors 108 and 109 are provided in the circuit between the power source and servomotor 94. These sensors function in the manner described above by interrupting the power to servomotor 94 depending on the amount of cable 60 deployed. For example, if first portion 63 reaches its near fully deployed length, sensor 108 would close a bypass loop to servomotor 94 to prevent further power thereto. These bypass arrangements could be timed such that servomotor 94 will be cut-off a predetermined time following the closing of the bypass loop.

When first portion 63 of cable 60 is abruptly pulled and then released so as to cause retraction of cable 60, the generator will generate a negative voltage, again open switch S1 and set the speed regulator SR to a higher permissible operation voltage for servomotor 94 in order to provide for sufficient power for retraction. A remote control unit for switch S1 could also be employed as illustrated in order to provide a desired supply of power to servomotor 94. Finally, in the preferred embodiment, a plurality of diodes (not shown) are placed across the windings of servomotor 94 to provide dynamic braking should first portion 63 be pulled when no power is applied to the reeling device 2. This prevents unwanted flywheeling of hub member 27 which could result in cable 60 becoming jammed within housing 5.

When first portion 63 is fully wound upon main hub portion 36, second portion 69 of cable 60 will also be in a first, fully wound state in one rotational direction about secondary hub portion 39 as illustrated in FIG. 4. When fully wound, second portion 69 is preferably provided with a little slack in order to assure non-binding of the device. As main hub portion 36 is rotated by tension applied to first portion 63 of cable 60, secondary hub portion 39 will be simultaneously rotated in the same rotational direction. When first portion 63 is approximately half deployed, second portion 69 will be fully unwound from secondary hub portion 39 as illustrated in FIG. 5. In this second sate, cable 60 within second chamber 20 will be free to loop and freely fall into the bin defined by second chamber 20. As first portion 63 continues to be deployed, second portion 69 will be rewound in an opposite direction onto secondary hub portion 39 as main hub portion 36 continues to rotate in the same direction. When first portion 63 is fully deployed, reeling device 2 will assume a third state as shown in FIG. 6 wherein second portion 69 of cable 60 is again fully wound upon secondary hub portion 39. The ability of second portion 69 to assume these three states within the bin defined by second chamber 20 results in a reduced cable length as compared to known prior art arrangements. This reduction in bin loading is very significant in avoiding jamming of the untensioned cable loop in the bin. Without this ability, the bin would have to handle as much cable as main reel 51 thereby requiring a much larger bin space in order to avoid the entrapment of loops of cable leading to jamming and malfunctioning of reeling device 2. If an initial pull is made on first portion 63 followed by a release thereof, servomotor 94 will automatically re-wind cable 60. As stated above, during retraction of first portion 63 of cable 60, servomotor 94 will maintain a requisite operational rate which will prevent any potentially dangerous coiling sequences from occurring.

From the above description, it should be readily apparent that second portion 69 of cable 60 is fully unwound from and then rewound onto secondary hub portion 39 within second chamber 20 as first portion 63 is fully unwound from main hub portion 36. The same sequence of events occurs upon rewinding of first portion 63 as well. By this arrangement, the length of second portion 69 can be greatly reduced as compared to known prior art arrangements. In fact, according to the preferred embodiment, a 3:1 ratio is obtained between the length of first portion 63 of cable 60 and second portion 69 which minimizes the required length of second portion 69 for a given length of first portion 63 as compared to the prior art. Naturally, this reduces the necessary size of housing 5 such that reeling device 2 can be made as small as possible.

Since transparent flange member 53 rotates in unison with main hub portion 36, no frictional forces are exerted on first portion 63 by either transparent flange member 53 or central flange 30. On the other hand, second chamber 20 is defined in part by fixed side wall 10 and also fixed partition member 14. As best shown in FIGS. 3 and 7, only auxiliary flange portion 41 of central flange rotates with second hub portion 39. However, auxiliary flange portion 41 is sized to extend radially from second hub portion 39 a distance at least equal to that of second portion 69 of cable 60 when second portion 69 is fully wound in order to reduce any binding. In addition, outer surface 50 of auxiliary flange portion 41 is spaced from side wall 10 a distance greater than the width of cable 60 as indicated by reference numeral 128 in FIG. 3 but less than twice the width. This precludes the development of packing forces that could result in progressive tightening and binding of the device if two fixed flanges were used. It is also possible to apply a low friction material, such as TEFLON to inner side 125 of side wall 10 as indicated at 12 in FIG. 3.

Although described with respect to a preferred embodiment of the invention, it should be understood that various changes and/or modifications can be made to the invention without departing from the spirit thereof. For example, it should be recognized that other types of drive transmission arrangements, such as direct gear drives, could be utilized. In addition, if reeling device 2 is utilized as a suspended system, a braking unit could also be incorporated in order to enable a payload carried by first portion 63 to be supported at a desired, elevated position. In general, the invention is only intended to be limited by the scope of the following claims.

I claim:

1. A method of reeling and unreeling a cable having a first portion wound upon a main reel that is rotatably mounted within a housing and a second portion wound upon a secondary reel that is rotatable with the main reel comprising:

unreeling a predetermined portion of the first portion of the cable from the main reel as the second portion of the cable is simultaneously unwound from the secondary reel into a bin portion of the housing that has an associated width that is slightly greater than the width of the cable;

continuing to unreel the first portion of the cable from the main reel as the second portion of the cable is simultaneously wound upon the secondary reel from the bin portion;

reeling a predetermined portion of the first portion of the cable unto the main reel as the second portion of the cable is simultaneously unwound from the secondary reel into the bin portion; and continuing to reel the first portion of the cable as the second portion of the cable is simultaneously wound upon the secondary reel.

2. A reeling device comprising:

a housing;

a partition member dividing said housing into first and second chambers;

a main reel mounted within the first chamber of said housing for rotation about a rotational axis, said main reel including a hub portion and at least one flange portion secured to said hub portion for rotation therewith, said hub portion having an associated diameter;

a secondary reel attached to said main reel for rotation therewith, said secondary reel including a hub portion extending within the second chamber of said housing and at least one flange portion rotatable with the hub portion of said secondary reel;

a cable including a first portion of predetermined length coiled about the hub portion of said main reel and a second portion of predetermined length that is less than the predetermined length of said first portion coiled about the hub portion of said secondary reel, said first portion terminating in one end portion of aid cable that is adapted to be pulled by an operator of said reeling device for deploying a desired length of the first portion of said cable, said second portion terminating in another end portion of said cable that is fixed to said housing; and a central hub member including first and second opposing sides, the hub portion of said main reel being secured to the first side of said central hub member and the hub portion of said secondary reel being secured to the second side of said central hub member, said central hub member including a hole extending between said first and second sides through which said cable extends;

wherein, as the first portion of said cable is fully unwound from said main reel, the second portion of said cable is simultaneously fully unwound from and then rewound onto said secondary reel within said second chamber.

3. A reeling device as claimed in claim, 2 wherein the hub portion of said secondary reel has an associated diameter that is less than the diameter associated with the hub portion of said main reel.

4. A reeling device as claimed in claim 3, wherein said main and secondary reels are integrally formed.

5. A reeling device as claimed in claim 2, wherein said central hub member further includes a central flange that defines, at least in part, the at least one flange portion of said main reel.

6. A reeling device as claimed in claim 5, further comprising means for driving said main reel for rotation about said rotational axis, said driving means being mounted within said housing and drivingly coupled to said main reel.

7. A reeling device as claimed in claim 6, wherein said driving means comprises a motor having an output member and means for drivingly coupling said output member to said central flange.

8. A reeling device as claimed in claim 7, wherein said means for drivingly coupling said output member to said central flange comprises an endless belt that extends around said central flange and said output member.

9. A reeling device as claimed in claim 2, further comprising means for driving said main reel for rotation about said rotational axis, said driving means being mounted within said housing and drivingly coupled to said main reel.

10. A reeling device as claimed in claim 9, further comprising means for activating and de-activating said driving means, so as to control the rotation of said main reel, based on sensed operating parameters of said reeling device.

11. A reeling device as claimed in claim 10, further comprising a transparent flange member attached to said main reel, said means for activating and de-activating including first and second sensors carried by said housing adjacent said transparent flange member, said sensors providing signals regarding the amount of cable wound upon said main reel.

12. A reeling device as claimed in claim 11, wherein said cable has an associated width and said at least one flange portion and said transparent flange member are spaced by a distance slightly greater than the width of said cable.

13. A reeling device comprising:

a housing:

a partition member dividing said housing into first and second chambers;

a main reel mounted within the first chamber of said housing for rotation about a rotational axis, said main reel including a hub portion and at least one flange portion secured to said hub portion for rotation therewith, said hub portion having an associated diameter;

a secondary reel attached to said main reel for rotation therewith, said secondary reel including a hub portion extending within the Second chamber of said housing and at least One flange portion rotatable with the hub portion of said secondary reel; and a cable including a first portion of predetermined length coiled about the hub portion of said main reel and a second portion of predetermined length that is less than the predetermined length of said first portion coiled about the hub portion of said secondary reel, said first portion terminating in one end portion of said cable that is adapted to be pulled by an operator of said reeling device for deploying a desired length of the first portion of said cable, said second portion terminating in another end portion of said cable that is fixed to said housing;

wherein, as the first portion of said cable is fully unwound from said main reel, the second portion of said cable is simultaneously fully unwound from and then rewound onto said secondary reel within said second chamber and wherein said second chamber is defined between said partition member and an outer wall of said housing, said second chamber has an associated width that is slightly greater then the width of said cable.

14. A reeling device as claimed in claim 13, wherein said outer wall includes an inner surface that is lined with a low friction material.

15. A reeling device comprising:

a housing:

a main reel mounted within said housing for rotation about a rotational axis, said main reel including a hub portion and at least one flange portion secured to said hub portion for rotation therewith, said hub portion having an associate diameter;

a secondary reel attached to said main reel for rotation therewith, said secondary reel including a hub portion and at least one flange portion rotatable with the hub portion of said secondary reel wherein the hub portion of said secondary reel has an associated diameter that is less than the diameter associated with the hub portion of said main reel;

a cable including a first portion of predetermined length coiled about the hub portion of said main reel and a second portion of predetermined length that is less than the predetermined length of said first portion coiled about the hub portion of said secondary reel;

a central hub member including first and second opposing sides, the hub portion of said main reel being integral with the first side of said central hub member and the hub portion of said secondary reel being integral with the second side of said central hub member, said central hub member including a hole extending between said first and second sides through which said cable extends and a central flange that defined, at least in part, the at least one flange portion of said main reel; and means for winding and unwinding said cable upon said first and second reels such that as the first portion of said cable is fully unwound from said main reel, the second portion of said cable is simultaneously fully unwound from and then rewound onto said secondary reel within aid second chamber.

16. A reeling device comprising:

a housing;

a main reel mounted with said housing for rotation about a rotational axis, said main reel including a hub portion and at least one flange portion secured to said hub portion for rotation therewith, said hub portion having an associated diameter;

a secondary reel attached to said main reel for rotation therewith, said secondary reel including a hub portion and at least one flange portion rotatable with the hub portion of said secondary reel;

a cable including a first portion of predetermined length coiled about the hub portion of said main reel and a second portion of predetermined length that is less that the predetermined length of said first portion coiled about the hub portion of said secondary reel; and means for winding and unwinding said cable upon said first and second reels such that as the first portion of said cable is fully unwound from said main reel, the second portion of said cable is simultaneously fully unwound from and then rewound onto said secondary reel within said second chamber, said means for winding and unwinding including means for driving said main reel for rotation about said rotational axis, said driving means being mounted within said housing and drivingly coupled to said main reel, and means for activating and de-activating said driving means, so as to control the rotation of said main reel, based on sensed operating parameters of said reeling device.

17. A reeling device as claimed in claim 16 further comprising a transparent flange member attached to said main reel, said means for activating and de-activating including first and second sensors carried by said housing adjacent said transparent flange member, said sensors providing signals regarding the amount of cable wound upon said main reel.

* * * * *